US010269332B1

(12) United States Patent
Rickard et al.

(10) Patent No.: US 10,269,332 B1
(45) Date of Patent: Apr. 23, 2019

(54) GEAR TUNER DEVICE FOR STRINGED INSTRUMENTS

(71) Applicant: William A. Rickard, Aurora (CA)

(72) Inventors: William A. Rickard, Aurora (CA); Michael Edward Rowe, Sr., Elkhart, IN (US)

(73) Assignee: William A. Rickard, Aurora (CA)

( * ) Notice: Subject to any disclaimer, the term of this patent is extended or adjusted under 35 U.S.C. 154(b) by 0 days.

(21) Appl. No.: 16/028,940

(22) Filed: Jul. 6, 2018

(51) Int. Cl.
*G10D 3/14* (2006.01)

(52) U.S. Cl.
CPC ..... *G10D 3/14* (2013.01)

(58) Field of Classification Search
CPC ..... G10D 3/14
USPC ..... 84/304, 305, 306
See application file for complete search history.

(56) References Cited

U.S. PATENT DOCUMENTS 3,830,132 A * 8/1974 Lowe ..... G10D 3/14 84/304
5,381,715 A * 1/1995 Spercel ..... G10D 3/14 84/304
5,767,427 A * 6/1998 Corso ..... G10D 3/14 84/306
7,816,594 B2 * 10/2010 Vochezer ..... G10D 3/14 84/305

FOREIGN PATENT DOCUMENTS

WO 2018201234 A1 11/2018

* cited by examiner

*Primary Examiner* — Jianchun Qin
(74) *Attorney, Agent, or Firm* — Grant Tisdall

(57) ABSTRACT

A tuner for a stringed instrument, comprising: a housing mounted to the stringed instrument; a knob coupled to one end of the housing; a post coupled to the other end of the housing, the knob and the post positioned on a rotation axis, the post for receiving a string and the knob for causing rotation of the post; a gear assembly mounted in the housing between the knob and the post, the gear assembly having a first gear for rotating about the rotation axis and a second gear mounted on a gear body, the second gear having a center axis offset from the rotation axis, the first gear being meshed with the second gear, the gear body including a plurality of pins, being opposed to the second gear, for positioning in a respective plurality of cavities in the housing; wherein the second gear being coupled to the knob and the first gear being coupled to the post.

18 Claims, 12 Drawing Sheets

GEAR TUNER DEVICE FOR STRINGED INSTRUMENTS

FIELD

The present disclosure relates generally to stringed instrument tuners.

BACKGROUND

This section provides background information related to tuner devices for stringed instruments which is not necessarily prior art to the inventive concepts associated with the present disclosure.

Stringed instruments require string tuning devices, in order to adjust the pitch of one or many tones from various strings in order to establish typical intervals between the different tones provided by the strings. It is important for the stringed instrument to be tuned and thus remain in tune, as an "out of tune" instrument will exhibit a pitch/tone that is either too high (sharp) or too low (flat) in relation to a given/desired reference pitch. While an instrument might be in tune relative to its own range of notes, it may not be considered 'in tune' if it does not match the chosen reference pitch. Some instruments can become 'out of tune' with temperature, humidity, damage, or just time, and must be retuned periodically.

Current state of the art for sting tuner devices are planetary geared tuning devices used on banjos and guitars, which can be are limited to a considered too low 4:1 gear ratio of reduction. These existing 4:1 ratio tuners are extremely temperamental/sensitive due to the lower 4:1 ratio and can require continual re-tuning to hold the instrument in tune. The use of a planetary gearing system only provides a very minimal holding power between the gears. As a result of this limiting design, the gears tend to back wind when under string tension, and cause the string to "un-tune" itself. To somewhat overcome this problem, the musician has to constantly re-tension the screw holding the tuner button (knob) which creates temporary friction between the internal planetary gears and the exterior tuner housing. This has become a major complaint in the banjo industry that has not been resolved to date.

Because of this issue, many professional musicians find it best to remove the planetary tuners and install higher ratio worm gear tuning devices when performing on stage. For worm gear tuners, as normally used on the guitar, the preferred tuning ratio is between 10:1 and 18:1, which assures accurate and smooth string tuning. However, even though the worm gear tuners as used on the majority of guitars today does solve the tuning issues for a banjo, these worm tuners are not preferred by many musicians as they appear out of place being mounted on a banjo and are not traditional in look/style. For example, the worm gear tuners are larger in form factor over that of the planetary gear tuners, and thus the worm gear tuners are not preferred by banjo players.

SUMMARY

This section provides a general summary of the inventive concepts associated with the present disclosure. Accordingly, this section is not intended to be interpreted as a comprehensive and exhaustive listing of all features, aspects, objectives and/or advantages associated with the inventive concepts which are further described and illustrated in the following detailed description and the appended drawings.

It is an object of the present invention to address the traditional looks of the existing planetary banjo tuner and the desire to hold the exterior dimensions as close as possible to the prior art planetary tuners.

It is an object of the present invention to provide alternative gearing to that presently being used in the stringed instrument industry, such as a cycloidal design.

It is an object of the present invention to provide a turn ratio higher than the typical 4:1 ratio, such as new a 10:1 ratio by example.

It is an object of the present invention to address gear slippage and the need to adopt crude methods of creating friction to eliminate any tuner "back winding".

A first aspect provided is a tuner device for a string of a stringed instrument, the tuner device comprising: a housing for mounting to a body of the stringed instrument; a tuning knob post coupled to one end of the housing; a string post coupled to the other end of the housing, the tuning knob post and the string post positioned on a rotation axis, the string post for receiving the string and the tuning knob for causing rotation of the string post during rotation of a transmission gear assembly mounted on an eccentric cam on the input tuning post and further rotating the string post. The gear assembly having a pair of gears including a second gear (e.g. transmission gear) driven by the eccentric cam on the input shaft (e.g. main post), for rotating about the rotation axis and a first gear mounted on a string post. The second gear having a center axis offset from the rotation axis, and having teeth for meshing with teeth of the first gear. A transmission gear body having the second gear includes a plurality of pins for positioning in a respective plurality of cavities in the housing, such that the plurality of pins on the gear body are opposed to the second gear on the gear body, the second gear being coupled to the tuning knob and the first gear being coupled to the string post; wherein turning of the tuning knob (resulting on turning of the main post) causes rotation of the first gear about the rotation axis with relative rotation of the second gear about the center axis in order to rotate the string post about the rotation axis while the plurality of pins move within their respective plurality of cavities.

A further aspect provided is a tuner device for a string of a stringed instrument, the tuner device comprising: a housing for mounting to a body of the stringed instrument; a tuning knob coupled to one end of the housing; a string post coupled to the other end of the housing, the tuning knob and the string post positioned on a rotation axis, the string post for receiving the string and the tuning knob for causing rotation of the string post during operation of the tuner device; and a gear assembly mounted in the housing between the tuning knob and the string post, the gear assembly having a pair of gears including a first gear for rotating about the rotation axis and a second gear mounted on a gear body, the second gear having a center axis offset from the rotation axis, the first gear having first teeth for meshing with second teeth of the second gear, the gear body including a plurality of pins for positioning in a respective plurality of cavities in the housing, such that the plurality of pins on the gear body are opposed to the second gear on the gear body, the second gear being coupled to the tuning knob and the first gear being coupled to the string post; wherein turning of the tuning knob causes rotation of the first gear about the rotation axis with relative rotation of the second gear about the center axis in order to rotate the string post about the rotation axis while the plurality of pins move within their respective plurality of cavities.

DRAWINGS

The drawings described herein are provided to illustrate selected, at least one non-limiting embodiment associated with the present disclosure and are not intended to limit the scope of the present disclosure.

FIG. 1*a* is an example of a stringed instrument as a banjo having a plurality of tuner devices;

FIG. 1*b* is a further example of a stringed instrument as a guitar having a plurality of the tuner devices of FIG. 1*a;*

Figure 1A:
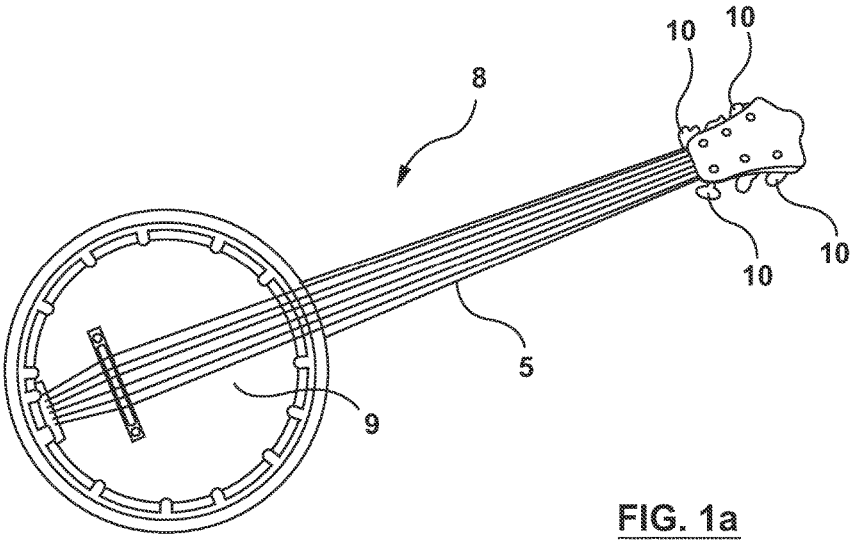
Figure 4A:
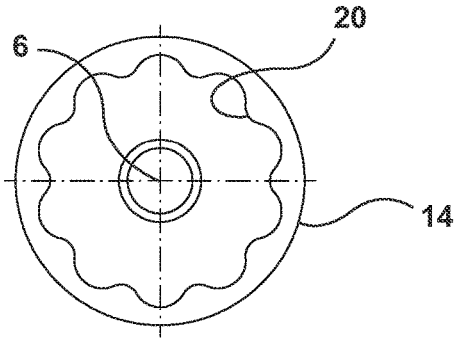

FIG. 4*a,b* show an end view and a side view of a string post component of the tuner device of FIG. 1*a;*

Figure 5:
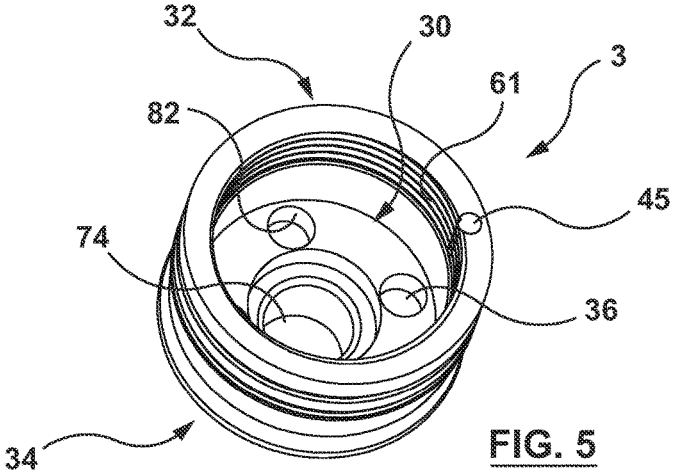

FIG. 5 shows a perspective view of an example transmission housing component of the tuner device of FIG. 1*a;*

Figure 6A:
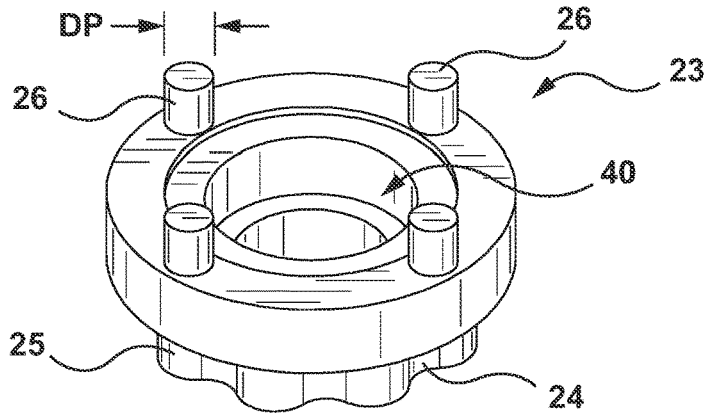
Figure 6B:
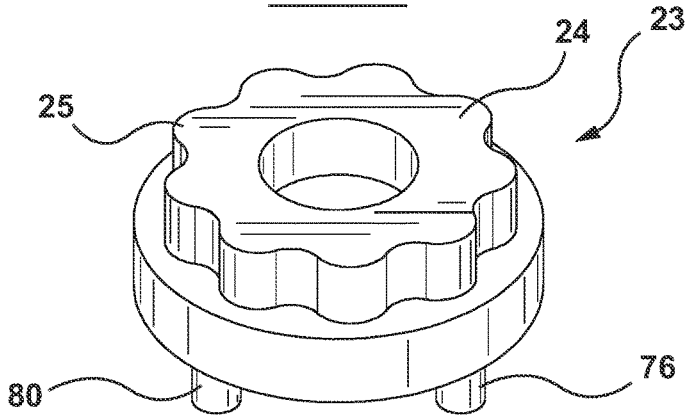

FIG. 6*a*,6*b* show bottom and top perspective views of an example gear body of a gear assembly of the tuner device of FIG. 1*a;*

Figure 7:
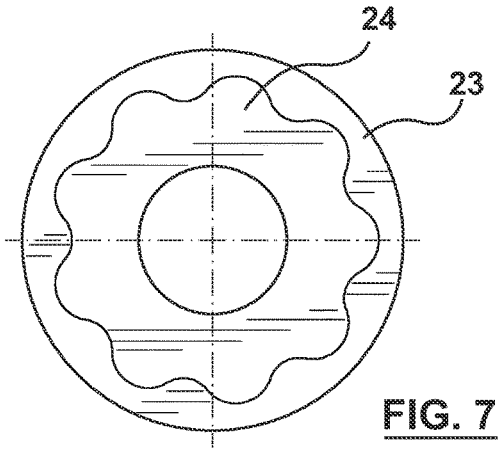

FIG. 7 shows a top view of the gear body of FIGS. 6*a,b;*

Figure 8A:
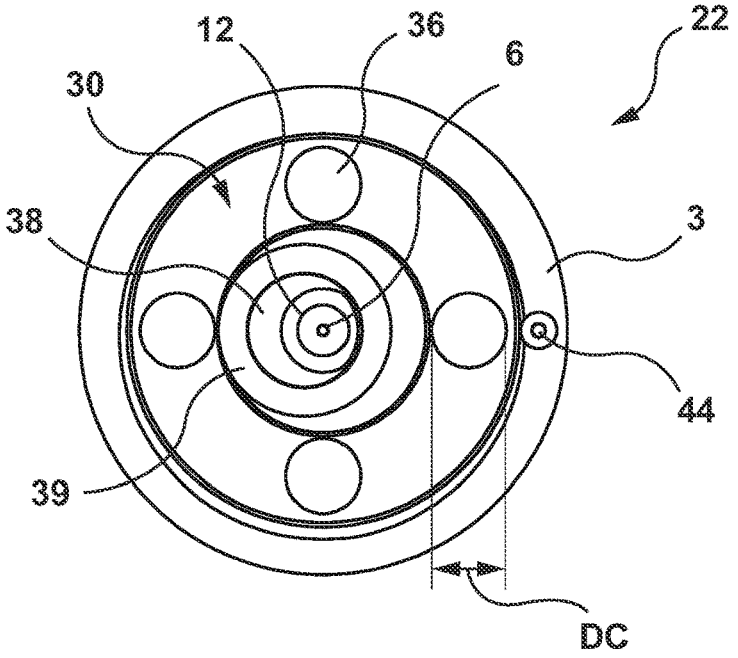
Figure 8B:
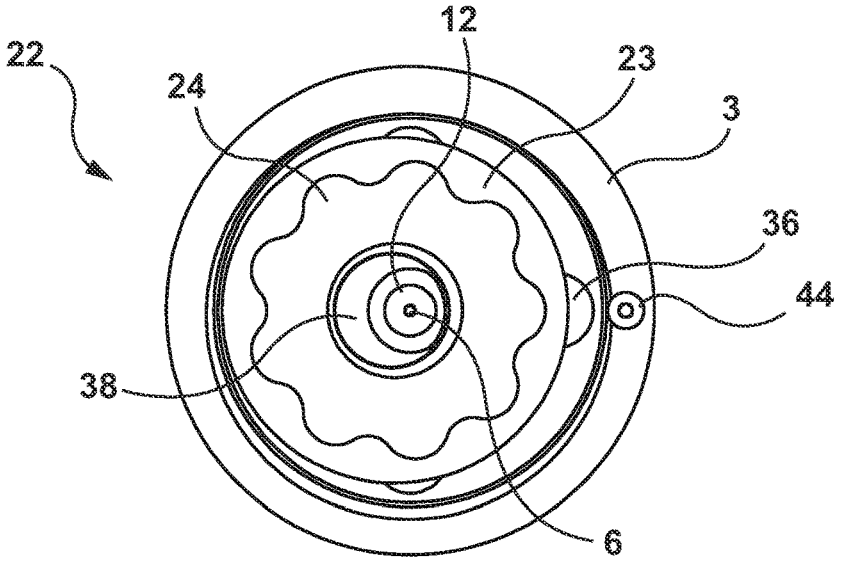
Figure 9:
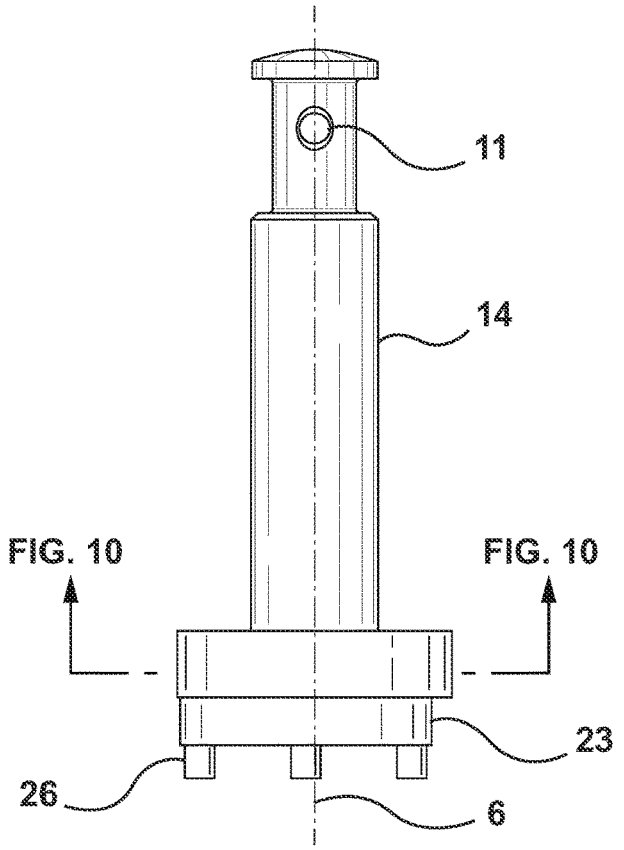

FIG. 8*a* shows a top view of the transmission housing component of FIG. 5;

FIG. 8*b* shows transmission housing component of FIG. 8*b* with gear body positioned therein;

FIG. 9 shows a side view of a coupling between the gear body and the string post of the tuner device of FIG. 1*a;*

Figure 10:
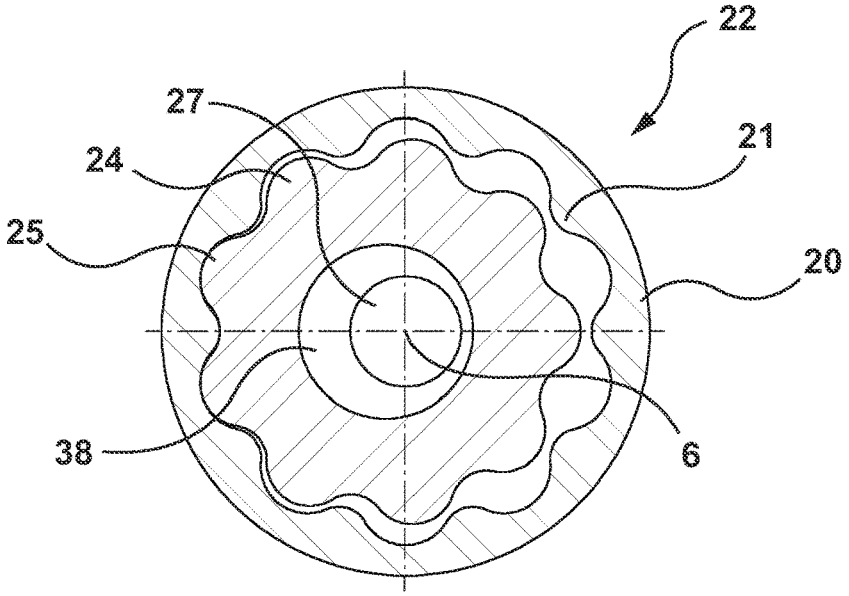

FIG. 10 shows a cross sectional view A-A of FIG. 9 showing the positions of gears of the gear assembly.

Figure 11:
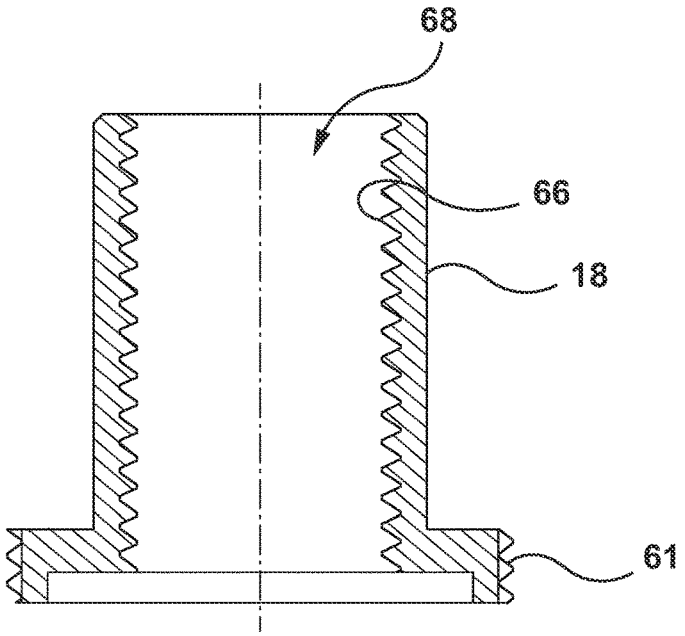

FIG. 11 show a cross sectional side view of a collar component of the tuner device of FIG. 1*a;*

Figure 12:
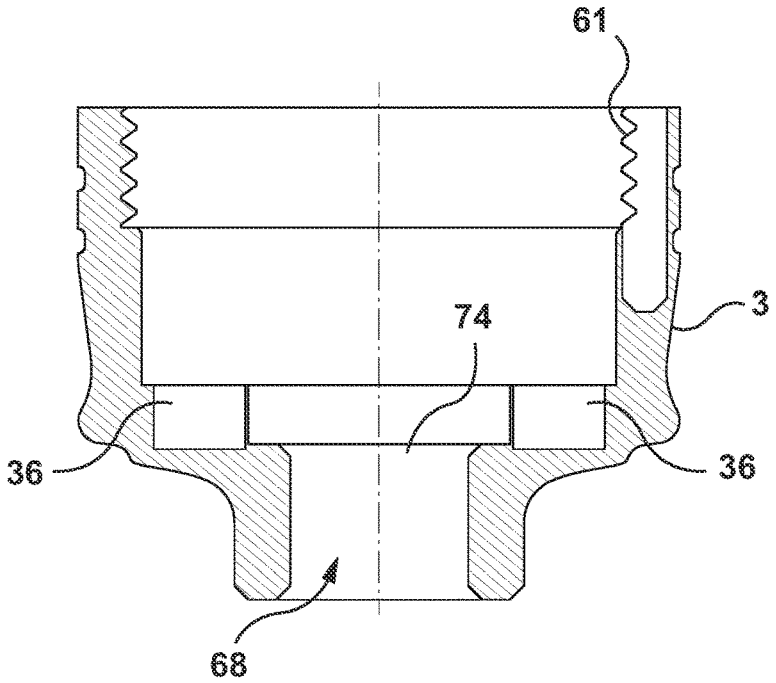
Figure 13:
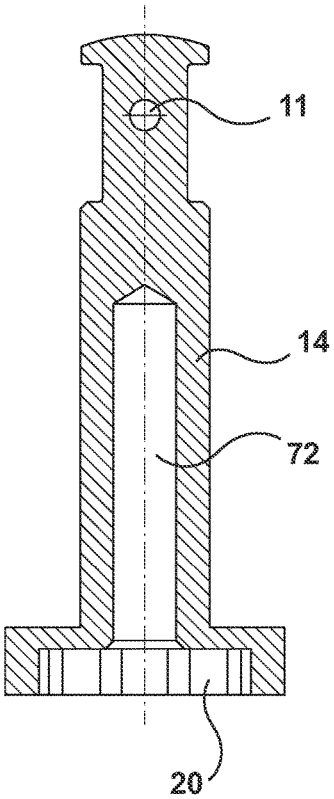

FIG. 12 shows a cross sectional side view of the transmission housing of FIG. 5;

FIG. 13 shows a cross sectional side view of the string post of FIGS. 4*a,b;*

Figure 14:
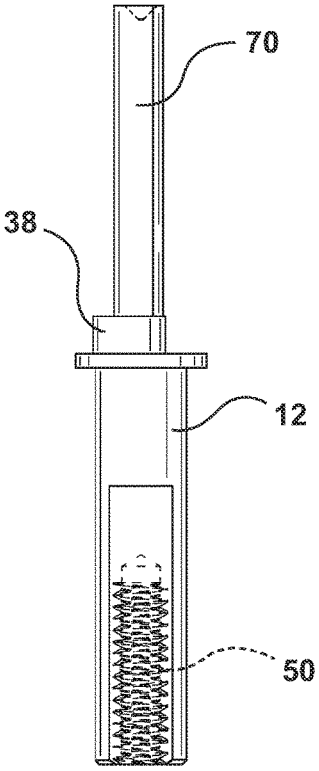

FIG. 14 shows a cross sectional side view of a main post component of the tuner device of FIG. 1*a;*

Figure 15:
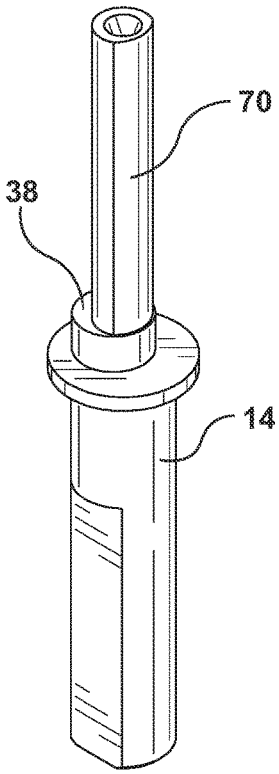
Figure 16:
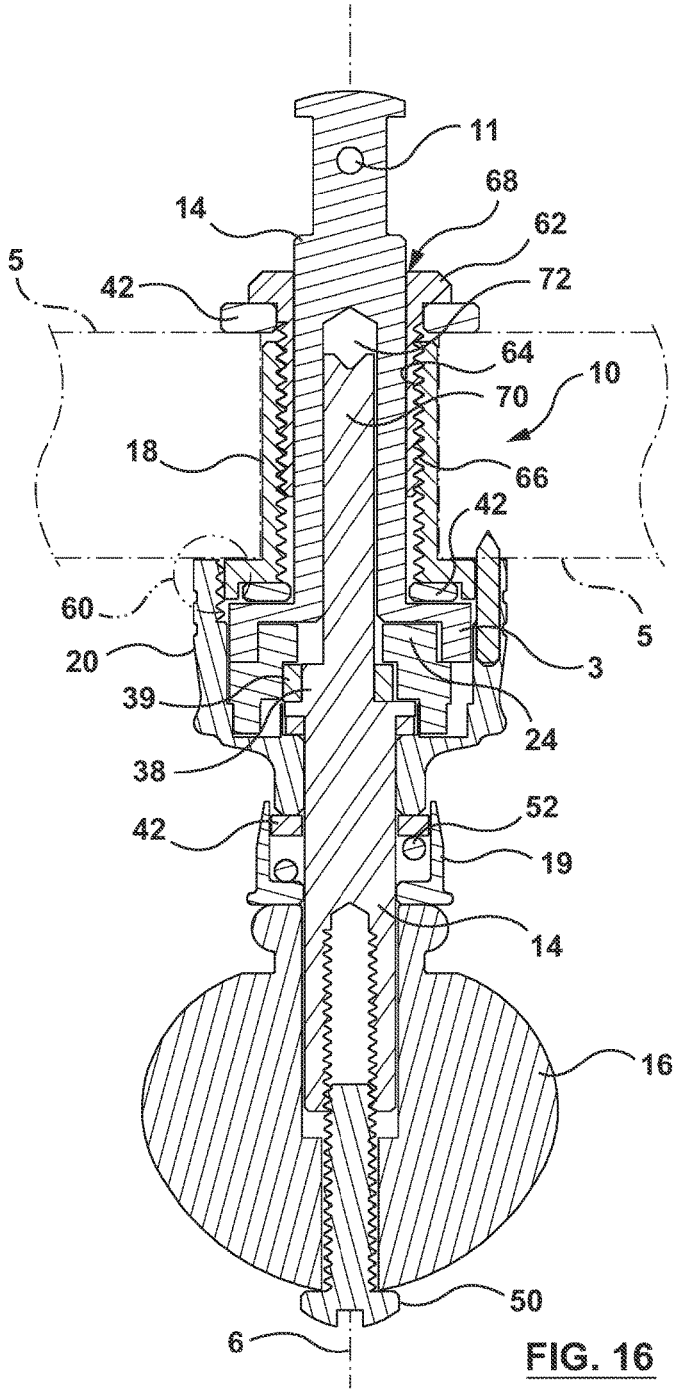
Figure 17A:
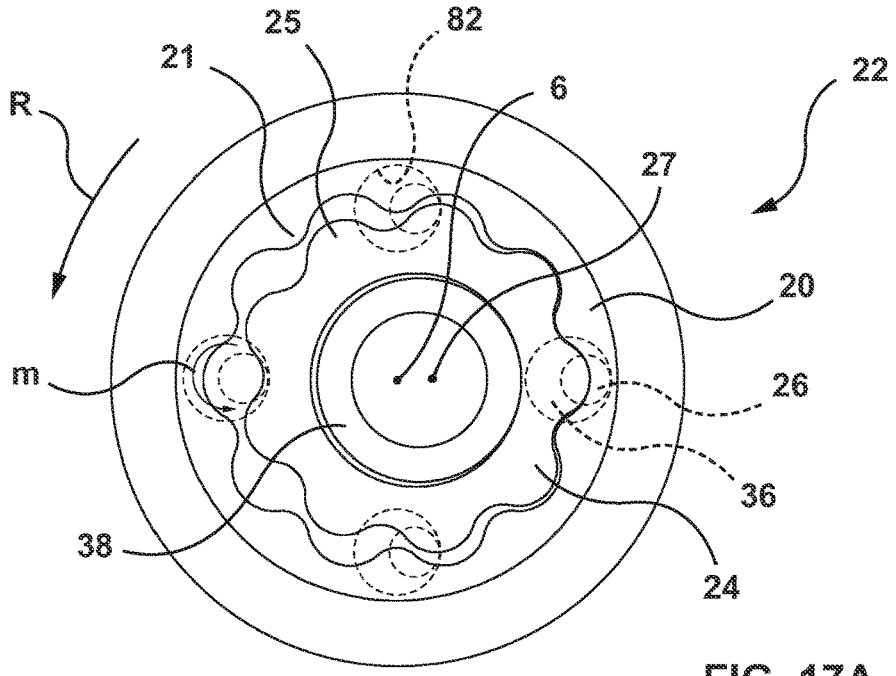
Figure 17B:
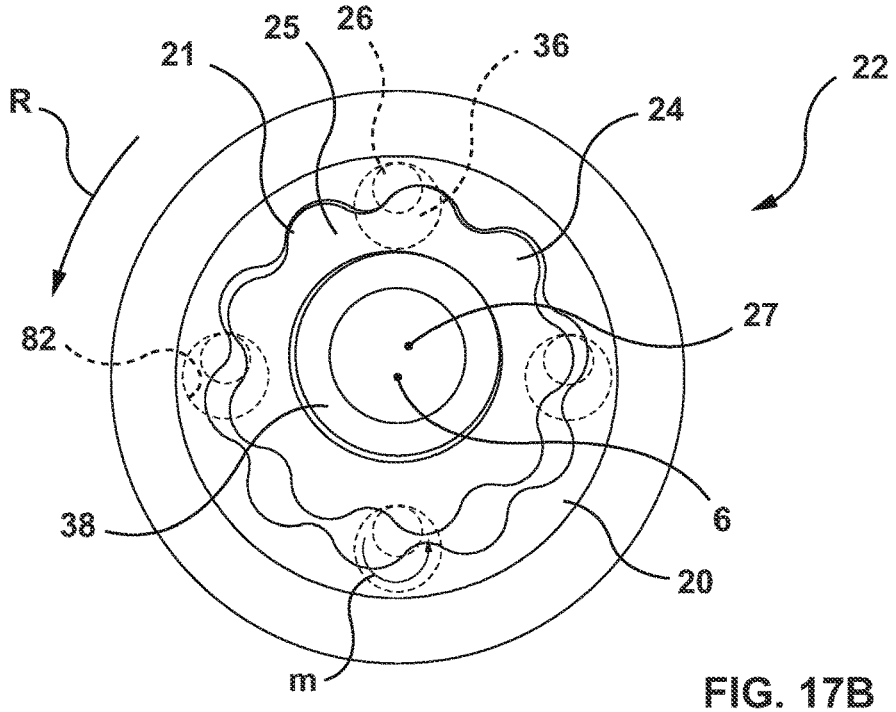
Figure 17C:
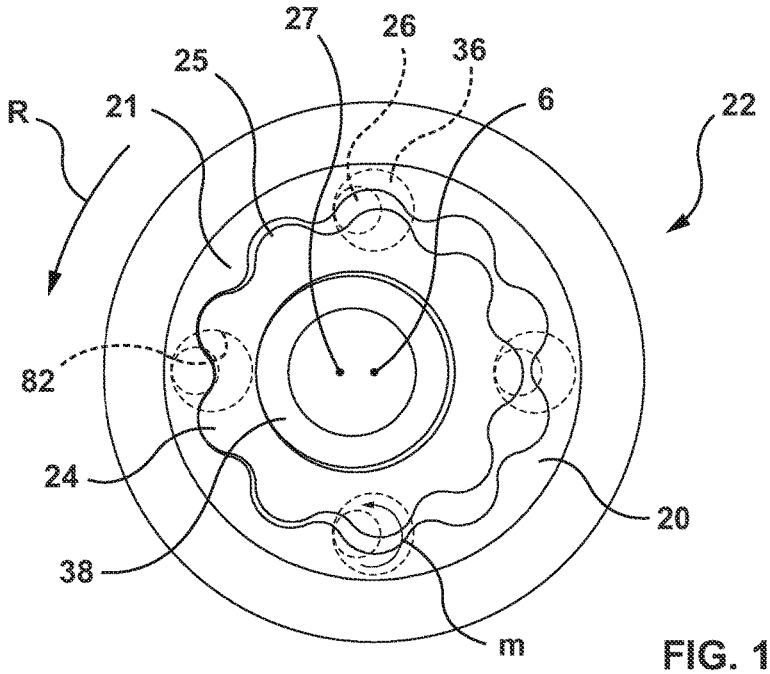
Figure 17D:
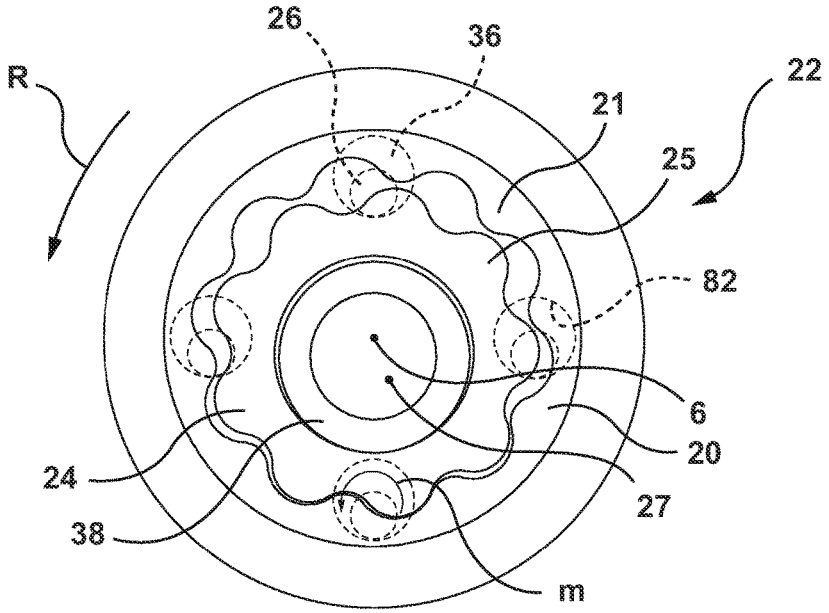

FIG. 15 shows a perspective view of the main post component of FIG. 14;

FIG. 16 shows a cross sectional view of the assembled tuner device of FIG. 1*a*; and FIG. 17*a,b,c,d* show various operation positions of the gear assembly of the tuner device of FIG. 1*a*.

Corresponding reference numerals are used to indicate corresponding components throughout the several views of the drawings.

DETAILED DESCRIPTION

Example embodiments will now be described more fully with reference to the accompanying drawings. To this end, the example embodiments are provided so that this disclosure will be thorough, and will fully convey its intended scope to those who are skilled in the art. Accordingly, numerous specific details are set forth such as examples of specific components, devices, and methods, to provide a thorough understanding of embodiments of the present disclosure. However, it will be apparent to those skilled in the art that specific details need not be employed, that example embodiments may be embodied in many different forms, and that neither should be construed to limit the scope of the present disclosure. In some example embodiments, well-known processes, well-known device structures, and well-known technologies are not described in detail. For example, the following figures and associated description provide as an example the design of a geared (e.g. 10:1) banjo string tuning device 10, to replace the existing limiting 4:1 ratio planetary geared tuners presently being used on banjos and guitars.

Figure 1B:
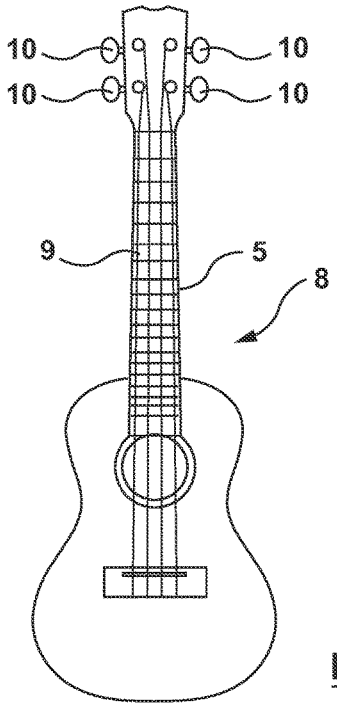
Figure 2:
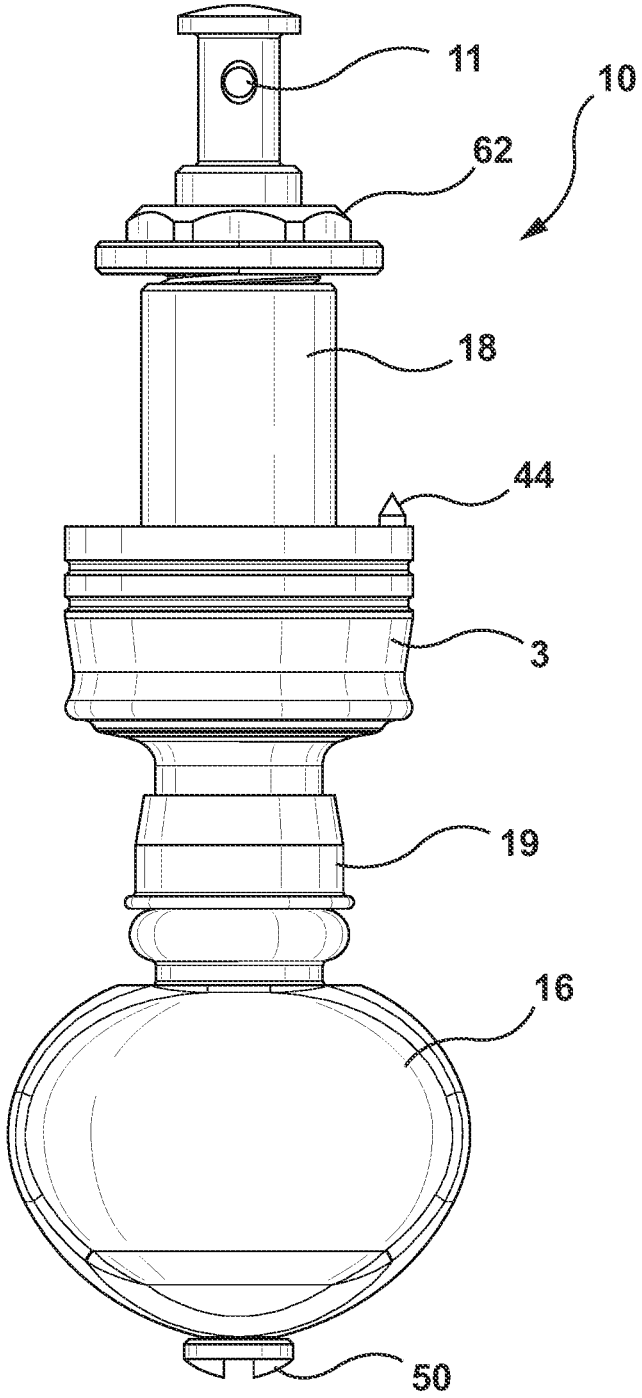
FIG. 2 is side view of an assembled tuner device of FIG. 1*a;*
Figure 3:
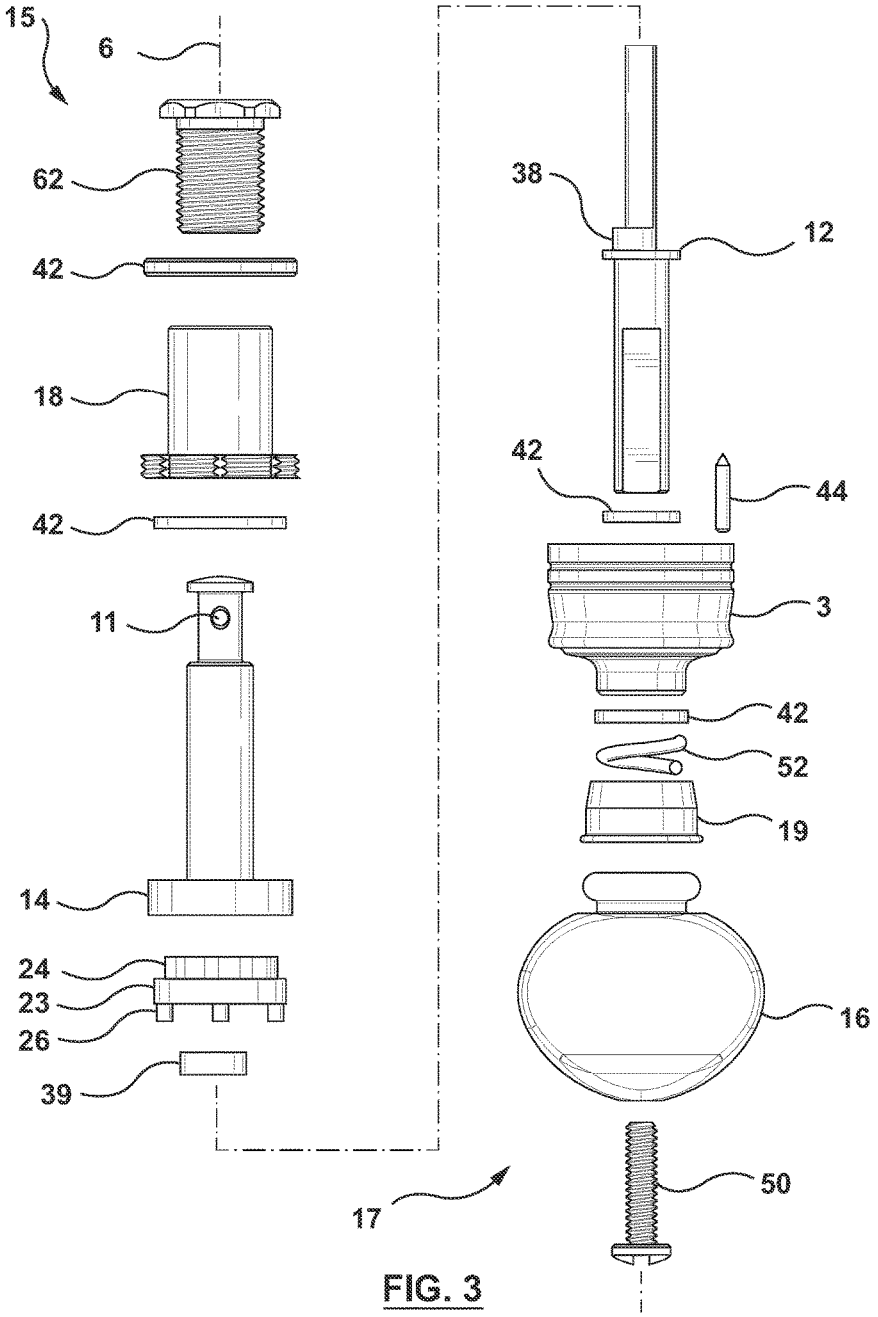
FIG. 3 is a side view of an exploded view of the tuner device of FIG. 1*a;*

Referring to FIGS. 1*a* and 1 *b*, shown are stringed instruments 8 having a plurality of strings 9, each of the strings 9 connected to a respective tuner device 10 via a hole 11. The tuner devices 10 are mounted on a body 5 of the stringed instrument 8. Referring to FIGS. 2 and 3, the tuner device 10 has a main post 12 for coupling with a string post 14 at one end 15 and a tuning knob 16 at the other end 17, such that the string post 14 contains the hole 11 for receiving the string 9. A collar 18 is used to retain the main post 12 coupled to a transmission housing 3 (e.g. a housing for mounting to the body 5), as further described below. In operation, a user of the tuner device 10 turns the knob 16 in order to rotate the main post 12, which in turn operates a gear assembly 22 (see FIG. 2) contained within the transmission housing 3. The tuner knob 16 can be coupled to the main post 12 via a fastener 50 (e.g. threaded screw used for releasably retaining the tuner knob 16 to the main post 12—for maintenance/repair purposes). A cup 19 can be used to house a resilient element 52 (e.g. coil spring) positioned between the cup 19 and the transmission housing 3, such that the resilient element 52 can be used to maintain the coupling (e.g. via fastener 50) of the tuner knob 16 to the main post 12 during multiple uses of the tuner device 10.

Figure 4B:
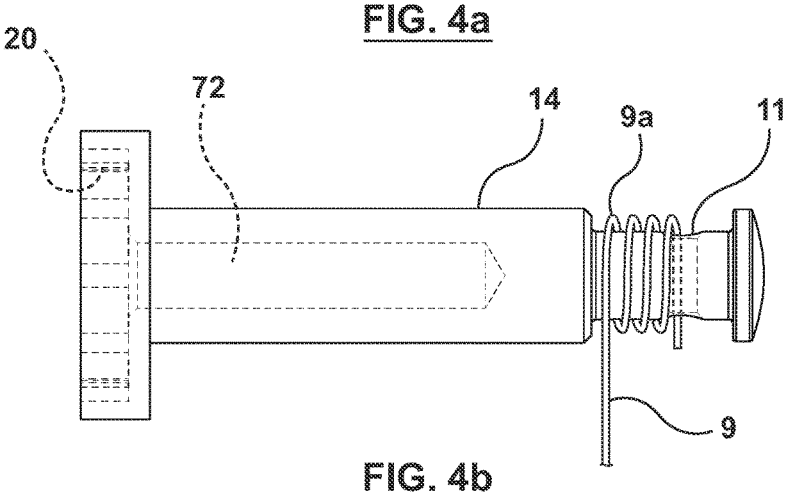

Operation of the gear assembly 22 is used to rotate the string post 14 (see FIG. 4), which is used to adjust a length 9*a* of the string 9 wrapped around a periphery of the string post 14 adjacent to the hole 11. As such, an increase/decrease in the length 9*a* of the string 9 wrapped around the string post 14 is used to change a tension of the string 9 and thus tune the string 9. It is recognized that the gear assembly 22 (see FIG. 10) provides a specified gear ratio (e.g. 10:1, 18:1, etc.), referred to as a tuning ratio, between the tuning knob 16 rotation (as mounted on the main post 12) relative to the string post 14 rotation.

Referring again to FIGS. 2, 3 and 10, the string post 14 has the hole 11 at one end and an internal gear 20 having internal teeth 21 at the other end. For example, the internal gear 20 can be a cylinder or disk with the teeth 21 projecting radially inwards towards a rotation axis 6. A gear body 23 (also see FIG. 6*a,b*) has an external gear 24 on one side and a plurality of pins 26 extending from the other side opposite to the external gear 24. The external gear 24 has external teeth 25, such that the internal teeth 21 and the external teeth 25 mesh with one another as the internal gear 20 and external gear 24 rotate relative to one another about the rotation axis 6. For example, the external gear 25 can be a cylinder or disk with the teeth 25 projecting radially outwards with respect to a center axis 27. As one example, the profile of the teeth 21, 25 can be of a cycloid profile, such that the gear tooth 21,25 profile can be based on an epicycloid curve or a hypocycloid curve (curves generated by a circle rolling around the outside and inside of another circle, respectively). As such, one example of the gear assembly 22 can be referred to as a cycloidal drive, made up of the internal gear 20 and the external gear 24. As further described below, the rotation axis 6 and the center axis 27 are offset from one another.

Referring to FIGS. 5 and 8*a,b*, the transmission housing 3 has an interior 30 as a receptacle, having an open end 32 for receiving the gear body 23 and a closed end 34 having a plurality of cavities 36 sized to receive the plurality of pins 26, i.e. one respective cavity 36 for each of the pins 26. An external dimension DC (e.g. diameter) of the cavity 36 is greater than an external dimension (e.g. diameter) DP of the pin 26. For example, the interior dimension DC (e.g. diameter) of the cavities 36 can be 0.103 inches while the exterior dimension DP (e.g. diameter) of the pins 26 can be 0.057 inches. As shown, the cavities 36 and pins are circular in cross section, however other cross sectional shapes (e.g. oval) are contemplated. For example, in operation of the tuner device 10, an exterior periphery 80 of each of the plurality of pins 26 remains in contact with an interior periphery 82 of each of the plurality of cavities 36 during the rotation of the gears 20,24 with respect to one another.

As shown in FIGS. 3, 6*a* and 10, the main post 12 has a lobe 38 (e.g. eccentric cam) that is used to couple the external gear 24 to the main post 12, thereby providing for an eccentric (or offset) positioning of the center 27 of the external gear 24 to the rotation axis 6. The lobe 38 sits within an aperture 40 of the external gear 24. As shown, the lobe 38 is eccentric to the rotation axis 6 and the aperture 40 is in the center 27 of the external gear 24. Alternatively, the lobe 38 can be symmetric about the rotation axis 6 while the aperture 40 can be off center of the external gear 24, thus also providing for the eccentric (or offset) positioning (e.g. 0.026 inches) of the center 27 of the external gear 24 with respect to the rotation axis 6. As such, as the main post 12 is rotated about the rotation axis 6, the interaction between the lobe 38 and the external gear 24 about the offset center 27 results in operation of the gear assembly 22 as the external gear 24 is rotated about the internal gear 20, i.e. rotation of the main post 12 drives conjoint rotation of the external gear 24 and thus that rotation of the external gear 24 induces/drives rotation of the internal gear 20 also about the rotation axis 6. Optionally, a spacer 39 (see FIG. 8*a*) can be positioned about the periphery of the lobe 38 such that wear contact between the lobe 38 and the interior of the aperture 40 is minimized. For example, the spacer 39 can be made of a plastic material while the external gear 24 and the lobe 38 are mode of a metal material (e.g. brass). As such, any wear between the lobe 38 and the aperture 40 could be experienced by the spacer 39 rather than the lobe 38 of the main post 12 and/or the external gear 24.

Referring to FIGS. 17*a,b,c,d*, positioning of the pins 26 within the cavities 36 changes as the external gear 24 rotates eccentrically within the internal gear 20, as facilitated by the dimension DC being greater than the dimension DP, see FIGS. 6*a*, 8*a*) as further discussed below.

Referring again to FIG. 3, the tuner device 10 can also have a series of spacers (or washers) 42 to inhibit wear of surfaces with respect to one another as the tuner device 10 is operated. For example, the washers 42 can be made of a wearable material (e.g. plastic) as compared to the components (e.g. 18, 14, 16, 19) material (e.g. metal) of the tuner device 10. The tuner device 10 can also have a rotation inhibiter element 44 (e.g. spike) for connecting the tuner device 10 into the body 5, as mounted in hole 45 of the transmission housing 3 (see FIG. 5) in order to inhibit rotation/movement of the tuner device 10 with respect to the body 5 of the instrument 8, once the tuner device 10 is mounted to the instrument body 5.

Referring to FIGS. 5, 11, 12 and 16, shown is an example of a coupling 60 between the collar 18 and the transmission housing 3, used in order to assembly the tuner device 10. As shown by example, the coupling 60 can be a releasably secured coupling such as a threaded 61 coupling. Further, referring to FIGS. 3, 13, 14, 15 and 16, positioning of the string post 14 with respect to the collar 18 about the rotation axis 6 can be facilitated by a position element 62, e.g. a threaded plug. The position element 62 can have threads 64 for coupling with threads 66 of the collar 18. The position element 62 and the collar 18 have apertures 68 (e.g. passageways) for receiving the string post 14 during assembly of the tuner device 10. Further, the main post 12 can have a spindle 70 for positioning/supporting the string post 14 on the rotation axis 6, such that the spindle 70 is received within a post cavity 72 of the string post 14. It is recognized that as the string post 14 is connected (e.g. coupled such as affixed thereto) to one of the gears (e.g. the internal gear 20) of the gear assembly 22 and the main post 12 is connected (e.g. coupled via the lobe 38) to the other of the gears (e.g. the external gear 24) of the gear assembly 22, the spindle 70 will rotate relative to the post cavity 72 due to the turn ration provided by the gear assembly 22 during operation thereof. As such, it is recognized that the main post 12 and the string post 14 are able to rotate relative to one another (i.e. non-conjointly) about the rotation axis 6 due to the turn ration provided by the gear assembly 22. The instrument body 6, in portion, is shown in ghosted view in FIG. 16, as an example of mounting of the tuner device 10. It is recognized that the position element 62 can be used with the transmission housing 3 to mount the tuner device 10 to the body 6 there-between. Further the cup 19 can be positioned between the tuning knob 16 and the housing 3 for facilitating relative rotational movement between the tuning knob 16 and the housing 3.

Referring again to FIGS. 5, 8*a*, 8*b*, 12 and 16, the transmission housing 3 at the closed end 34 can optionally have a receptacle situated 74 between the cavities 36, the receptacle 74 dimensioned to accommodate the eccentric motion of the lobe 38 (and optional spacer 39) about the rotation axis 6. As such, it is recognized that the cavities 36 are distributed about the rotation axis 6. For example, the number of cavities 36 (and respective pins 26) can be 4. During operation of the tuner device 10, variable positioning of the pins 26 within the cavities 36 (see Figured 17*a,b,c,d*) provides for multiple lock positions of the external gear 24 within the internal gear 20 about the rotation axis 6. As such, due to multiple lock positions (e.g. facilitated via friction between an exterior surface 80 (see FIG. 6*b*) of the pins 26 and an interior surface 82 (se FIG. 5) of the cavities 36), the rotation of the string post 14 can be held at various selected rotational positions about the rotation axis 6. In other words, once the length 9*a* of the string 9 is increased or decreased (i.e. selected) about the periphery of the string post 14 via tuning of the tuner knob 16 by the user, release of the tuning knob 16 by the user results in the position of the pins 26 within the cavities 36 as maintained. Therefore, once a degree of rotation of the tuning knob 16 about the rotation axis 6 is selected by the user, further rotation of the tuning knob 16 once released by the user is inhibited at least in part due to the frictional interaction between the pins 26 and the cavities 36. It is also recognized that frictional interaction between the teeth 21,25 can contribute to inhibiting further rotation of the tuning knob 16, once released by the user.

Referring to FIGS. 17*a,b,c,d* during operation of the gear assembly 22 the gear 20 and the gear 24 rotate R relative to one another about the rotation axis 6, as the center 27 of the gear 24 changes position about the rotation axis 6 under driving influence of the lobe 38. As can be seen, the pins 26 also move M about the periphery 82 of the cavities 36 in a cyclic pattern (e.g. circular) as the gears 20,24 rotate R with respect to one another as the teeth 21,25 are engaged. It is noted that the direction of cyclic movement M and the rotation R are both in the same direction, e.g. clockwise or counterclockwise, as the gear assembly 22 is operated via turning of the tuner knob 16. It is recognized that the one gear 20 rotates about the rotation axis 6, the other gear 24 rotates about is center axis 27, the center axis 27 rotates about the rotation axis 6 due to the eccentric motion of the gear 24 relative to the gear 20, and the pins 26 each move with their respective cavities 36 about the interior periphery 82 (e.g. peripheral surface) of their cavity 36.

In view of the above, the tuner device 10 can be for tensioning a string 9 of a stringed instrument 8, the tuner device 10 comprising: a housing 3 for mounting to a body 5 of the stringed instrument 8; a tuning knob 16 (mounted on a main post 12) coupled to one end of the housing 3; a string post 14 coupled to the other end of the housing 3, the main post 12 and the string post 14 positioned on a rotation axis 6, the string post 14 for receiving the string 9 and the tuning knob 16 for causing rotation of the string post 14 during rotation of a transmission gear assembly 22 mounted on an eccentric cam 38 (e.g. lobe) on the input tuning post (e.g. main post 12) and further rotating the string post 14. The gear assembly 22 having a pair of gears including a second gear (e.g. transmission gear) 24 driven by the eccentric cam 38 on the input shaft (e.g. main post 12), for rotating about the rotation axis 6 and a first gear 20 mounted on the string post 14. The second gear 24 having a center axis 27 offset from the rotation axis 6, and having teeth 25 for meshing with teeth 21 of the first gear 20. The transmission gear body 23 having the second gear 24 includes a plurality of pins 26 for positioning in a respective plurality of cavities 36 in the housing 3, such that the plurality of pins 26 on the gear body 23 are opposed to the second gear 24 on the gear body 23, the second gear 24 being coupled to the tuning knob 16 (e.g. via the lobe 38) and the first gear 20 being coupled to the string post 14; wherein turning of the tuning knob 16 (resulting in turning of the main post 12) causes rotation of the first gear 20 about the rotation axis 6 with relative rotation of the second gear 24 about the center axis 27 in order to rotate the string post 14 about the rotation axis 6 while the plurality of pins 26 move within their respective plurality of cavities 36.

We claim:

1. A tuner device for a string of a stringed instrument, the tuner device comprising:

a housing for mounting to a body of the stringed instrument;

a tuning knob coupled to one end of the housing;

a string post coupled to the other end of the housing, the tuning knob and the string post positioned on a rotation axis, the string post for receiving the string and the tuning knob for causing rotation of the string post during operation of the tuner device; and a gear assembly mounted in the housing between the tuning knob and the string post, the gear assembly having a pair of gears including a first gear for rotating about the rotation axis and a second gear mounted on a gear body, the second gear having a center axis offset from the rotation axis, the first gear having first teeth for meshing with second teeth of the second gear, the gear body including a plurality of pins for positioning in a respective plurality of cavities in the housing, such that the plurality of pins on the gear body are opposed to the second gear on the gear body, the second gear being coupled to the tuning knob and the first gear being coupled to the string post;

wherein turning of the tuning knob causes rotation of the first gear about the rotation axis with relative rotation of the second gear about the center axis in order to rotate the string post about the rotation axis while the plurality of pins move within their respective plurality of cavities.

2. The tuner device of claim 1, wherein the first gear is coupled to one end of the string post.

3. The tuner device of claim 1 further comprising a main post for rotation about the rotation axis, the main post coupled to the tuning knob at one end and also coupled to the second gear via a lobe, wherein rotation of the lobe via rotation of the main post causes the relative rotation of the second gear about the center axis.

4. The tuner device of claim 3 further comprising the string post having a receptacle for receiving a spindle of the main post.

5. The tuner device of claim 1, wherein an exterior periphery of each of the plurality of pins remains in contact with an interior periphery of each of the plurality of cavities during the rotation of the second gear about the center axis.

6. The tuner device of claim 5, wherein the number of the plurality of pins is 4.

7. The tuner device of claim 1 further comprising a lobe for driving the rotation of the second gear, the lobe positioned on the rotation axis.

8. The tuner device of claim 7, wherein the lobe is an eccentric lobe, such that a center of the lobe corresponds with the center axis of the second gear.

9. The tuner device of claim 8 further comprising a spacer positioned between the lobe and the second gear, the spacer for inhibiting wear between the second gear and the lobe.

10. The tuner device of claim 8 further comprising a main post positioned on the rotation axis, such that the lobe is positioned on the main post.

11. The tuner device of claim 1 further comprising the first teeth and the second teeth being of cycloidal profile.

12. The tuner device of claim 11, wherein the first gear is an internal gear having the first teeth extending towards the axis of rotation and the second gear is an external gear having the second teeth extending from the center axis.

13. The tuner device of claim 1 further comprising a collar for coupling the string post to the housing, such that the housing is a transmission housing for the gear assembly.

14. The tuner device of claim 13, wherein the coupling between the collar and the transmission housing is threaded, such that the string post rotates relative to the collar during operation of the tuner device.

15. The tuner device of claim 13 further comprising a position element for positioning the collar about the rotation axis.

16. The tuner device of claim 15, wherein the position element is used with the transmission housing to mount the tuner device to the body.

17. The tuner device of claim 1 further comprising cup positioned between the tuning knob and the housing for facilitating relative rotational movement between the tuning knob and the housing.

18. The tuner device of claim 1 further comprising a resilient element positioned between the cup and the housing.

* * * * *